United States Patent [19]

Thrash

[11] Patent Number: 5,040,479

[45] Date of Patent: Aug. 20, 1991

[54] ILLUMINATED MULTIPLE COLOR BUTTON AND METHOD OF MANUFACTURING THE SAME

[75] Inventor: Penelope L. Thrash, Arlington Heights, Ill.

[73] Assignee: Apollo Plastics Corporation, Chicago, Ill.

[21] Appl. No.: 557,570

[22] Filed: Jul. 24, 1990

[51] Int. Cl.[5] ..... H01H 9/18

[52] U.S. Cl. ..... 116/279; 200/314

[58] Field of Search ..... 116/279, 335; 362/23, 362/26, 85; 40/546, 547, 331; 200/310-315; 340/815.13

[56] References Cited

U.S. PATENT DOCUMENTS

| | | | |
|---|---|---|---|
| 3,518,386 | 6/1970 | Guberman | 200/313 |
| 4,307,047 | 12/1981 | Edinger et al. | 264/25 |
| 4,391,764 | 7/1983 | Edinger et al. | 264/25 |
| 4,395,611 | 7/1983 | Kondo et al. | 200/314 |
| 4,551,598 | 11/1985 | Hamilton et al. | 200/314 |
| 4,668,450 | 5/1987 | Blochl et al. | 264/25 |
| 4,683,359 | 7/1987 | Wojtanek | 200/314 |
| 4,710,330 | 12/1987 | Lewandowski et al. | 264/25 |
| 4,778,966 | 10/1988 | Obata et al. | 200/314 |

FOREIGN PATENT DOCUMENTS

| | | | |
|---|---|---|---|
| 2803539 | 8/1979 | Fed. Rep. of Germany | 200/314 |
| 3235752 | 3/1984 | Fed. Rep. of Germany | 200/314 |

OTHER PUBLICATIONS

New CR103 Type C Square Indicating Lights . . . , Feb. 1965, General Electric.

*Primary Examiner*—William A. Cuchlinski, Jr.
*Assistant Examiner*—W. Morris Worth
*Attorney, Agent, or Firm*—Neuman, Williams, Anderson & Olson

[57] ABSTRACT

A multiple color illuminated button to control a device or functions of a device. The button has a first color for the letters and a second color for the graphics when the button is not illuminated and a third color for the letters and a fourth color for the graphics when the button is illuminated. In one embodiment of this invention, the button includes a transparent light pipe and a cap. The upper surface of the light pipe is painted or decorated with a paint or other material. The upper exterior surface of the cap is painted or decorated with a paint or other material. The exterior of the cap is then painted with a second layer of paint. After the second layer has cured, the letters and graphics are laser etched onto the upper surface of the cap. The laser removes preselected portions of the paint layer to expose the surface below the second layer. In another embodiment, the button includes a chassis and a cap. The interior and exterior surfaces of the cap may be decorated or painted as previously described.

23 Claims, 1 Drawing Sheet

ILLUMINATED MULTIPLE COLOR BUTTON AND METHOD OF MANUFACTURING THE SAME

BACKGROUND OF THE INVENTION

This invention relates to an illuminated button and more particularly to a multiple color illuminated button.

Buttons and knobs are used in many different applications as a means to control a device or functions of a device. For example, an automobile will have push buttons to activate the heating, ventilation or air conditioning functions. Similarly, the radio in an automobile will have push buttons or knobs to control the volume, adjust the receiver frequency, activate receiver presets or cassette tape functions.

Furthermore, these buttons are often used in a low light environment such as an automobile at night. Thus, it is necessary to illuminate the buttons so that the user can easily locate the button to activate the device or function. Often, these buttons are illuminated by a light source which is located behind the button. The light is then transmitted through a portion of the button so that the user can easily locate the button in a low light environment.

In order for the user to identify the function of the button, the surface of the button contains letters or graphics or both which describe the function of the button. For example, the button may have the letters "R DEF" which is the abbreviation for rear window defroster and may also have a graphic which shows heat rays directed at a rectangle which represents a window.

Sometimes, the users of these buttons require that the letters or graphics should have a first color during the day time, i.e. a reflected color, and a second color during the night time, i.e. a transmitted color, when the button is illuminated from behind. Thus, these buttons have one color day time and a second color night time.

A desirable feature or characteristic for these buttons would be the use of multiple colors for the letters and graphics. Specifically, there is a need for a button which has two colors for the letters and graphics during the day time and two colors for the letters and graphics during night time. For example, during the day time the letters would be a first color and the graphics would be a second color. During the night time when the button is illuminated by a light source located behind the button, the letters would be a third color and the graphics would remain the second color. Consequently, there is a need for a two color day time and two color night time button.

Another desirable feature or characteristic for these buttons would be a manufacturing method which reduced manufacturing costs, improved quality and permitted greater flexibility in the manufacturing process. The previous method of manufacture utilized a single component construction with several coats of paint.

This previous method of manufacture created several problems. For example, when several layers of paint are used to manufacture a button, solvents are trapped between each layer of paint even if the catalyst paints are fully cured. When the buttons are assembled into the device, i.e., radio or dashboard assembly, and are used in environmental extremes of hot or cold, the heat will soften the residual solvents and the paint on the buttons will become tacky or viscous. The buttons will then bind or stick in the device which is not desirable.

The trapped or residual solvents also present a further problem. The multiple layers of paint trap the solvents beneath the top or upper layer of paint, which is superficially cured, and prevents the solvents from escaping or evaporating through the top layer of paint. Consequently, the initial bond between the molded substrate and the first layer of paint is undermined by the pressure of the solvents attempting to escape from beneath the top layer of paint. Thus, the paint layers delaminate from the molded substrate which is not desirable.

Another problem with painting the buttons is the difficulty in the controllability and repeatability of the painting process. The users of these buttons specify tolerances with respect to transmitted color values. The thickness of the paint layer which is applied to the button has a direct relationship to the transmitted color value of the graphics or letters. The thickness of the paint layer will vary when a spray painting process is used to apply the paint layers. In addition, the paint color will vary between different paint lots during the production process.

Another problem encountered in the manufacture of the buttons is the difficulty in applying paint or other decoration to any surface other than the top of the button due to the size and depth of the button. Specifically, it is very difficult to apply paint or other decoration to the inside of the button. Consequently, there is a need for a manufacturing process which facilitates the application of paint or other decoration to the button.

Accordingly, it is an object of this invention to provide an illuminated multiple color button which has two reflected colors during the day time and two illuminated colors during the night time.

Another object of this invention is to provide a manufacturing method for illuminated multiple color buttons which reduces manufacturing costs, improves the quality of the product, and permits greater flexibility in the manufacturing process.

An additional object of this invention is to provide an illuminated multiple color button which has a minimum number of paint layers.

A further object of this invention is to provide an illuminated multiple color button which will not be affected by environmental extremes, such as heat.

Another object of this invention is to provide an illuminated multiple button whereby the paint layers will not delaminate from the molded substrate.

An additional object of this invention to provide a manufacturing method for illuminated multiple color buttons which has a controllable and repeatable method of applying the paint layers to the button.

A further object of this invention is to provide a manufacturing method for illuminated multiple color buttons which facilitates the application of paint or other decoration to the button.

Other objects and advantages of the invention will become apparent upon reading the following detailed description and appended claims, and upon reference to the accompanying drawings.

SUMMARY OF THE INVENTION

The aforementioned requirements and objects are satisfied through the illuminated multiple color button of this invention and method of manufacturing the same.

In one embodiment of this invention, the illuminated multiple color button includes a transparent light pipe and a cap. The upper surface of the cap will have letters or a graphic or both. The light pipe has a rectangular upper portion and a lower portion which extends downward and away from the upper portion. The distal end of the lower portion has two legs for attaching the light pipe to the device.

The top or upper surface of the light pipe is painted or decorated with a paint or other material. The shape or configuration of the paint layer will depend upon the design of the particular button. The paint layer will normally correspond with the letters or graphic on the cap.

The cap has a box shape which includes an exterior upper surface and four vertical sides. Similarly, the interior surfaces of the cap include an interior upper surface and four vertical interior sides. The interior surface of the cap may be painted or decorated with a paint or other material. In an alternative embodiment, a color filter may be sandwiched between the light pipe and the cap.

The upper exterior surface of the cap is painted or decorated with a paint or other material. In one particular embodiment, this first layer of paint, ink or other material only covers a small portion of the upper surface and corresponds to the graphic on the cap. The shape or configuration of this first paint or ink layer will depend upon the design of the particular button.

The exterior surfaces of the cap are then painted with a top coat or second paint layer. After the top coat has cured, the letters or graphics or both are laser etched onto the upper surface of the cap. The laser removes preselected portions of the paint layer to expose the surface below the top coat.

In one particular embodiment, the button operates in the following manner. During the day time or when the button is not illuminated from behind, the letters have a reflected or first color which is the color of the base material of the cap and the graphic has a reflected or second color which is the color of the first layer of paint, ink or other material.

During the night time or when the button is illuminated from behind, the letters have a transmitted or third color. In one particular embodiment, the third color corresponds to the color of the layer of paint, ink or other material on the light pipe. The graphic has a transmitted or fourth color during the night time. In one particular embodiment, the fourth color is the second color since no color filters have been positioned between the light source and the graphic on the cap.

In another embodiment of this invention, the illuminated multiple color button includes a chassis and a cap. The chassis has a light shaft which extends from the bottom of the chassis to the top of the chassis. The light shaft allows the light to travel upward from the light source and contact the upper interior surface of the cap. Four circular grooves are located around the perimeter of the chassis. These circular grooves are used to secure the cap to the chassis. The chassis is made of an acetal or polycarbonate material which is injection molded into the desired shape or configuration.

The cap has a box shape which includes an exterior upper surface and four vertical exterior sides. The interior cavity of the cap includes four vertical posts which are molded into the cap. The vertical posts engage the circular grooves in the chassis and hold the cap onto the chassis.

The interior and exterior surfaces of the cap may be decorated or painted as previously described. In addition, the two component assembly, i.e., the chassis and cap, allows a color filter to be positioned or sandwiched between the upper surface of the chassis and the interior surface of the cap.

DESCRIPTION OF THE DRAWINGS

For a more complete understanding of this invention reference should now be had to the embodiments illustrated in greater detail in the accompanying drawings and described below by way of examples of the invention. In the drawings.

It should be understood that the drawings are not necessarily to scale and that an embodiment is sometimes illustrated in part by schematic and fragmentary views. Furthermore, it should be understood, of course, that the invention is not necessarily limited to the particular embodiments illustrated herein.

DESCRIPTION OF THE INVENTION

Figure 1:
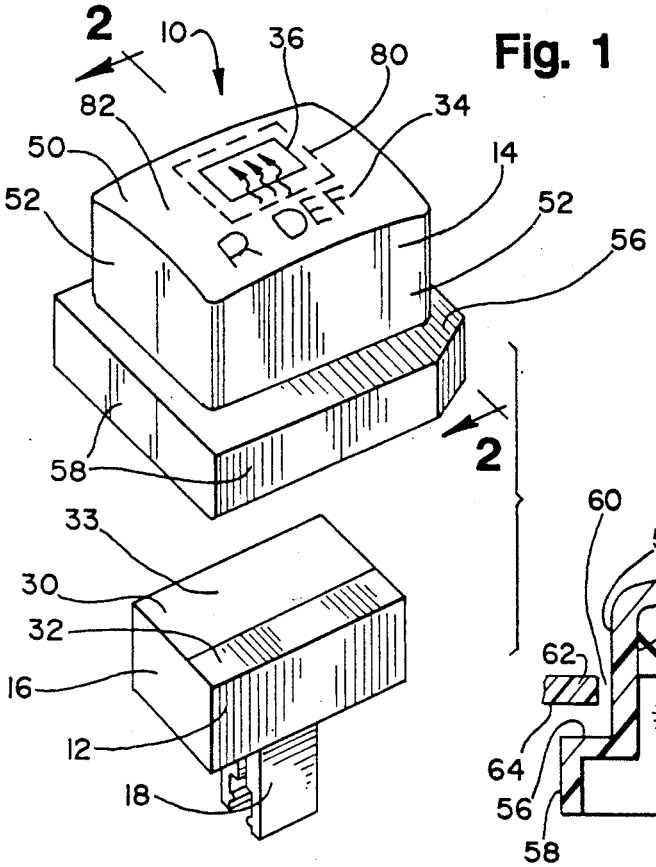
FIG. 1 is a three dimensional exploded view of an illuminated multiple color button of this invention.

Referring to FIG. 1, an illuminated multiple color button is indicated generally by the reference numeral 10. The button 10 includes a transparent light pipe 12 and a cap 14. The transparent light pipe 12 has a rectangular upper portion 16 and a lower portion 18. In this particular embodiment, the upper portion 16 and lower portion 18 are molded so that they are one component.

Figure 2:
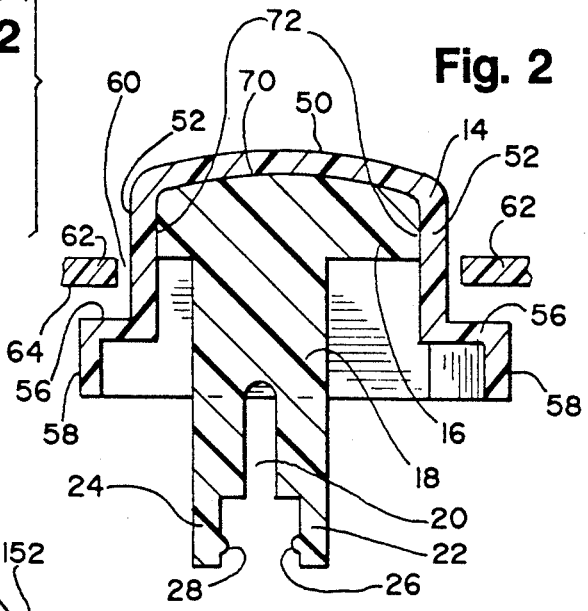
FIG. 2 is a sectional view taken along line 2—2 of the illuminated multiple color button of FIG. 1.

As shown in FIG. 2, the lower portion 18 has a rectangular configuration which extends downward and away from the upper portion 16. The distal end of lower portion 18 has an attachment means for attaching the light pipe to the device. In this particular embodiment, the attachment means is slot 20 which is molded into the end of lower portion 18. The slot 20 forms two legs 22 and 24 which extend downward. Two longitudinal ribs 26 and 28 are also molded onto the interior surfaces near the bottom of legs 22 and 24 respectively. The legs 22 and 24 are designed to be positioned over the appropriate attachment portion of the switching mechanism (not shown) in the device. The ribs 26 and 28 would grip the attachment portion to prevent the removal of the light pipe 12 and the entire button 10 from the device. The configuration of the attachment means will vary depending upon the design of the switching mechanism in the device.

The lower portion 18 is also used to transmit light from the light source (not shown) to the upper portion 16. The light source would be located in or near the switching mechanism of the device. In addition, the light source would also transmit light directly to the bottom surface of the upper portion 16.

The upper portion 16 of the light pipe 12 also has a rectangular configuration and is located above the lower portion 18. As shown in FIG. 2, the upper portion 16 is molded according to very specific tolerances so that the upper portion 16 fits closely in a mating relationship with the interior surfaces of the cap 14. This mating relationship assures that light is properly transmitted to the cap 14 and minimizes the transmission loss between the light pipe 12 and the cap 14.

The top or upper surface 30 of the upper portion 16 may be painted or decorated with a paint or other material. In this particular embodiment, the upper surface has a layer 32 of paint, ink or other material which only covers approximately one half of the upper surface 30. The remaining portion 33 does not have a layer of paint or ink. This paint or ink layer 32 corresponds to the letters 34, i.e. "R DEF", on the upper surface of the cap 14. Consequently, when light is transmitted through the upper portion 12 of the light pipe, the color of the paint or ink layer 32 will be transmitted to the underside of the cap 14 below the letters 34. Conversely, when light is transmitted through the unpainted portion 33 of the upper portion 12, the color of the light source or the color of the pipe 12 will be transmitted to the underside of the cap 14 below the graphic 36.

The ink layer 32 is applied by pad printing or silk screening the ink onto the upper surface 30. The shape or configuration of the paint layer 32 will depend upon the design of the particular button. For example, if the letters or graphic were small in size relative to the upper surface of the button, then only a small portion of the upper surface 30 would be printed or screened. Conversely, if the design required that both the letters and the graphic should have a transmitted color, then the entire upper surface 30 would be printed or screened The ink layer 32 is vinyl or acrylic ink. The thickness of the ink layer is approximately 1 mil. The color of the ink will depend upon the color which is desired by the customer. In addition, as noted above the ink must be capable of transmitting light through the ink layer 32.

The light pipe 12 is made of an acrylic or polycarbonate material which is injection molded into the desired shape or configuration. For example, the light pipe 12 can be made of acrylic which is sold by Rohm & Haas under the tradename plexiglas. The light pipe 12 can also be made of polycarbonate which is sold by General Electric Plastics under the tradename Lexan. In addition, the material must be capable of transmitting light at the photometric value which is specified by the customer. As previously noted, the material for the light pipe 12 shall be suitable for spray painting, pad printing, silk screening or other methods of surface decoration. Furthermore, the material for the light pipe 12 may be clear or may be a predetermined color. The predetermined color is added to the material prior to the injection molding process. The color of the light pipe 12 will depend upon the color which is desired by the customer.

Referring to FIG. 1, the cap 14 has a box shape which includes an exterior upper surface 50 and four vertical exterior sides 52. In this particular embodiment, the cap 14 also has a ledge portion 54 around the perimeter and near the base of the cap 14. The ledge portion 52 includes a land or horizontal surface 56 which is located around the perimeter of the cap 14 and four vertical sides 58 which extend downward from the land 56.

As shown in FIG. 2, the cap 14 is positioned in the device so that the upper surface 50 is exposed to the user of the device. Specifically, cap 14 is located in an appropriate aperture 60 in the face plate 62 of the device so that the upper surface 50 is flush with the plate 62, protruding above the face plate 62 or slightly below the face plate 62. In this particular embodiment, the upper surface 50 is above the face plate 62. This arrangement allows the user to activate the device by touching or turning the exposed portion of the button or knob.

In addition, the land 56 is positioned behind the face plate 62 and prevents the cap 14 from being withdrawn through the aperture 60. Specifically, the land 56 is larger than the aperture 60. Consequently, if the user attempted to withdraw the button, the land 56 would contact the underside 64 of face plate and would prevent the removal of the cap 14 through the aperture 60.

The interior surfaces of the cap 14 include the interior upper surface 70 and four vertical interior sides 72. As previously noted, the cap 14, and particularly the interior surfaces 70 and 72, are molded according to very specific tolerances so that the upper portion 16 of the light pipe 12 fits closely in a mating relationship with the interior surfaces 70 and 72 of the cap 14.

The interior upper surface 70 of the cap 14 may be painted or decorated with a paint or other material. In this particular embodiment the interior upper surface 70 is neither painted nor decorated. However, this two component assembly, i.e., the light pipe 12 and cap 14, allows the manufacturer to spray paint, pad print or otherwise decorate the interior surfaces of the cap 14 prior to the assembly of the button 10. Furthermore, this arrangement allows a color filter (not shown) to be positioned or sandwiched between the upper surface 30 of the light pipe 12 and the upper interior surface 70 of the cap 14. This color filter may be used separately or in combination with the paint layers which can be applied to the upper surface 30 of the light pipe and the upper interior surface 70 of the cap.

Referring to FIG. 1, the upper exterior surface 50 can be painted or decorated with a paint, ink or other material. In this particular embodiment, the upper surface 50 has a ink layer 80 (indicated by dotted lines) which only covers a small portion of the upper surface 50. This ink layer 80 corresponds to the graphic 36. This ink layer 80 is applied by pad printing or silkscreening the ink onto the upper surface 50. The shape or configuration of the ink layer 80 will depend upon the design of the particular button. For example, if the letters or graphic were small in size relative to the upper surface of the button, then only a small portion of the upper surface 50 would be decorated to create ink layer 80.

The ink layer 80 is made of acrylic or vinyl ink. The thickness of the ink layer 80 is approximately 1 mil. The color of the ink will depend upon the color which is desired by the customer. In addition, the ink must be capable of transmitting light through the ink layer 80.

After the layer 80 of paint, ink, or other material has cured, the exterior surfaces 50, 52, 56 and 58 of the cap 14 are painted with a top coat or paint layer 82. The paint layer 82 is applied by spray painting over the exterior surfaces. The paint layer 82 has a thickness of 0.7 to 1.3 millimeter to ensure proper paint coverage and appropriate laser etching of the letters or graphics. The paint is urethane paint and the color of the paint layer 82 will depend upon the color which is desired by the customer.

After the paint layer 82 has cured, the letters 34 or graphics 36 or both are laser etched onto the upper surface of the cap 14. The process of laser etching letters and graphics is well known in the art. The laser removes preselected portions of the paint layer 82 to expose the surface below the paint layer 82. In this particular embodiment, when the laser removes the paint layer 82 to create the letters 34, the laser exposes the base material of the cap 14. Consequently, the reflected color of the letters 34 is the color of the base material. When the laser removes the paint layer 82 to create the graphic 36, the laser exposes the ink layer 80 which is underneath paint layer 82. Therefore, the reflected color of the graphic 36 is the color of the ink layer 80.

The cap 14 is made of an acrylic or polycarbonate material which is injection molded into the desired shape or configuration. For example, the cap 14 can be made of polycarbonate which is sold by General Electric Plastics under the tradename Lexan. In addition, the cap material must be capable of transmitting light at the photometric value which is specified by the customer. As previously noted, the material of the cap 14 shall be suitable for spray painting or other method of surface decoration. Furthermore, the material for the cap 14 may be clear or may be a predetermined color. The predetermined color is added to the material prior to the injection molding process. The color of the cap material will depend upon the color which is desired by the customer.

After the painting and laser etching operations, the cap 14 is then assembled to light pipe 12 to create button 10. Specifically, the light pipe 12 is inserted into the interior cavity of cap 14. The button 10 is then attached or installed into the device.

In this particular embodiment, the button 10 operates or functions in the following manner. During the day time or when the button is not illuminated from behind, the letters 34 have a reflected or first color which is the color of the base material of the cap 14. The graphic 36 has a reflected or second color which is the color of the layer 80 of paint, ink or other material. During the night time or when the button is illuminated from behind, the letters 34 have a transmitted or third color which is the color transmitted to the exterior surface of the cap.

This transmitted or third color will depend upon the method utilized to manufacture the button. This third color can be the color of the light source, the color of the light pipe material, the color of the paint layer 32 on the light pipe, the color of the color filter sandwiched between the light pipe 12 and the cap 14, the color of the paint layer on the interior upper surface 70 of the cap 14 or a combination of these colors.

For example, in this particular embodiment, the transmitted or third color of the letters 34 is the color of the paint layer 32 on the light pipe 12. The light source transmits light through the light pipe 12 which transmits light through the paint layer 32. The light then passes through the base material of the cap 14 and is projected outward through the letters 34.

Similarly, during the night time or when the button is illuminated from behind, the graphic 36 has a transmitted or fourth color which is the color which is transmitted to the exterior of the upper surface of the cap. This transmitted or fourth color will depend upon the method utilized to manufacture the button. This fourth color can be the color of the light source, the color of the light pipe material, the color of the paint layer on the light pipe, the color of the color filter sandwiched between the light pipe 12 and the cap 14, the color of the paint layer on the interior upper surface 70 of the cap 14, the color of the layer 80 of paint, ink or other material, or a combination of these colors.

For example, in this particular embodiment, the transmitted or fourth color is the second color, i.e., the color of ink layer 80 on the cap 14. The light source transmits light through the light pipe 12 which transmits light through the base material of the cap 14. The light then passes through the ink layer 80 and is projected outward through the graphic 36.

Figure 3:
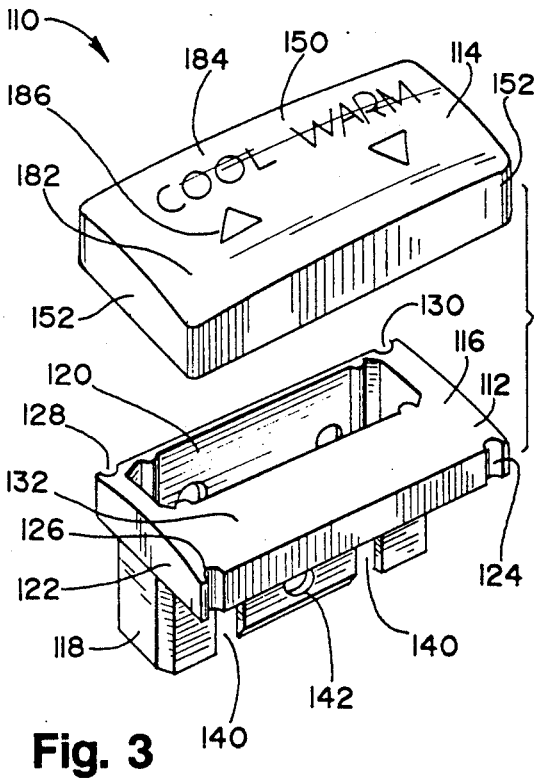
FIG. 3 is a three dimensional exploded view of an alternative embodiment of an illuminated multiple color button of this invention.

Referring to FIG. 3, an alternative embodiment of an illuminated multiple color button is indicated generally by the reference numeral 110. The button includes a chassis 112 and a cap 114. The chassis 112 has a rectangular upper chassis portion 116 and a rectangular lower chassis portion 118. In this particular embodiment, the upper chassis portion 116 and the lower chassis portion 118 are molded so that they are one component.

A rectangular light shaft 120 is located inside the upper and lower chassis portions 116 and 118 and extends from the bottom of the lower chassis portion to the top of the upper chassis portion. The light shaft 120 allows light to travel upward from the light source (not shown) and contact the upper interior surface of the cap 114. The upper chassis portion 116 has a ledge portion 122 which extends over and above the lower chassis portion 118. The upper chassis portion 116 is molded according to very specific tolerances so that the upper portion 116 fits closely in mating relationship with the interior surfaces of the cap 114.

Four circular grooves 124, 126, 128 and 130 are located around the perimeter of the upper chassis portion 116. These circular grooves extend from the upper surface 132 of the chassis to a depth slightly greater than the height of the cap 114. These circular grooves are used to secure the cap 114 to the chassis 112. The number and location of the grooves can vary depending upon the design of the particular button.

The lower chassis portion 118 has a rectangular configuration which extends downward and away from the upper portion 116. The distal end of the lower chassis portion 118 has an attachment means for attaching the button 110 to the device. In this particular embodiment, the attachment means includes four vertical slots 140 and two oval apertures 142. Only two of the slots 140 and one of the oval apertures are shown in FIG. 3 because the other two slots and oval aperture are on the opposite side of the lower chassis portion.

The oval apertures 142 are aligned with each other and are located in the center of the lower chassis portion 118. A pivot pin (not shown) is inserted into the oval apertures 142 and allows the user to pivot or rock the button in either direction. The slots 140 are attached to the switching mechanisms (not shown) of the device. When the user pushes the button on the left side, the button pivots to the left and activates the switching mechanism on the left side. Similarly, if the user pushes the button on the right side, the button pivots to the right and activates the switching mechanism on the right side. However, the configuration of the attachment means will vary depending upon the design of the switching mechanism in the device.

The chassis 112 is made of an acetal or polycarbonate material which is injection molded into the desired shape or configuration. For example, the chassis can be made of polycarbonate which is sold by General Electric Plastics under the tradename Lexan. In addition, the material for the chassis 112 shall be suitable for spray painting or other methods of surface decoration. Furthermore, the material for the chassis 112 may be black, white or another predetermined color. The color is added to the material prior to the injection molding process. A black chassis may be used to reduce or tone down an excessively bright light source. Conversely, a white chassis may be used to enhance a poor light output from a light source.

The color of the chassis will depend upon the color which is desired by the customer. If the customer requires white interior surfaces and black exterior surfaces, then the chassis 112 will be molded in white and the exterior surfaces of the chassis will be spray painted with black paint.

Referring to FIG. 3, the cap 114 has a box shape which includes an exterior upper surface 150 and four vertical exterior sides 152. The cap 114 is positioned in the device so that the upper surface 150 is exposed to the user of the device. This arrangement allows the user to activate the device by touching the exposed portion of the button.

Figure 4:
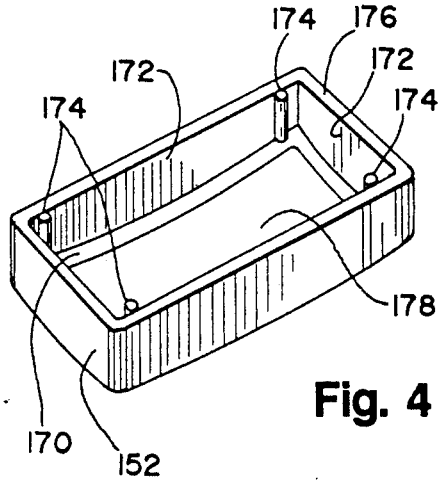
FIG. 4 is a bottom view of the cap portion of the illuminated multiple color button of FIG. 3.

Referring to FIG. 4, the interior surfaces of the cap 114 include the interior upper surface 170 and four vertical interior sides 172. As previously noted, the cap 114, and particularly the interior surfaces 170 and 172, are molded according to very specific tolerances so that the upper portion 116 of the chassis 112 fits closely in a mating relationship with the interior surfaces 170 and 172 of the cap 114.

Four vertical posts 174 are molded into the upper surface 170 and the side walls 172 of the cap. These posts 174 extend from the upper interior surface 170 to slightly below the top surface 176 of the side walls. When the cap 114 is positioned on the chassis 112, the posts 174 engage the circular grooves 124 in the chassis. The posts and grooves are dimensioned so as to achieve a friction fit between the posts and grooves. This friction fit holds the cap onto the chassis and prevents the cap from being easily removed. In order to facilitate the assembly of the cap 114 to the chassis 112, the top portion of the posts 174 are conical in shape.

The interior upper surface 170 of the cap may be painted or decorated with a paint or other material. In this particular embodiment, the interior upper surface 170 has an ink layer 178 which has been pad printed onto the interior surface 170. This two component assembly, i.e., the chassis 112 and the cap 114, allows the manufacturer to spray paint, pad print or otherwise decorate the interior surfaces of the cap 114 prior to the assembly of the button 110. Furthermore, this arrangement allows a color filter (not shown) to be positioned or sandwiched between the upper surface 132 of the chassis 112 and the upper interior surface 170 of the cap 114. This color filter may be used separately or in combination with the ink layer which can be applied to the upper interior surface 170 of the cap.

Referring to FIG. 3, the upper exterior surface 150 of the cap can be painted or decorated with a paint or other material. In this particular embodiment, the upper surface 150 does not have a decorative layer. However, as previously discussed for the other embodiment of this invention, the decorative ink layer usually covers a small portion of the upper surface 150 and corresponds to letters or a graphic.

After the decorative ink layer cures (assuming a decorative layer has been applied), the exterior surfaces 150 and 152 of the cap 114 are painted with a top coat or paint layer 182. The paint layer 182 is applied by spray painting the exterior surfaces. The paint layer has a thickness of 0.7 to 1.3 mil to ensure proper paint coverage and appropriate laser etching of the letters or graphics. The paint is urethane paint. The color of the paint layer will depend upon the color which is desired by the customer.

After the paint layer 182 has cured, the letters 184 or graphics 186 or both are laser etched onto the upper surface of the cap 114. The laser removes preselected portions of the paint layer 182 to expose the surface below the paint layer 182. In this particular embodiment, when the laser removes the paint layer 182 to create the letters 184 and the graphic 186, the laser exposes the base material of the cap 114. Consequently, the reflected color of the letters and graphics is the color of the cap material.

The cap 114 is made of an acrylic or polycarbonate material which is injection molded into the desired shape or configuration. For example, the cap 114 can be made of polycarbonate which is sold by General Electric Plastics under the tradename Lexan. In addition, the cap material must be capable of transmitting light at the photometric value which is specified by the customer. As previously noted, the material of the cap 114 shall be suitable for spray painting or other method of surface decoration. Furthermore, the material for the cap 114 may be white or may be a predetermined color. The predetermined color is added to the material prior to the injection molding process. The color of the cap material will depend upon the color which is desired by the customer.

After the painting and laser etching operations, the cap 114 is then assembled to chassis 112 to create button 110. Specifically, the chassis 112 is inserted into the interior cavity of cap 114. The button 110 is then attached or installed into the device.

In this particular embodiment, the button 110 operates or functions in the following manner. During the day time or when the button is not illuminated from behind, the letters 184 have a reflected or first color which is the color of the base material of the cap 114. The graphic 186 has a reflected or second color which is also the color of the base material of the cap 114.

During the night time or when the button is illuminated from behind, the letters 184 have a transmitted or third color which is the color transmitted to the exterior surface of the cap. This transmitted or third color will depend upon the method utilized to manufacture the button. This third color can be the color of the light source, the color of the decorative layer of paint or ink, the color of the ink layer 178 on the interior upper surface of the cap 114 or a combination of these colors.

For example, in this particular embodiment, the transmitted or third color of the letters 186 is the color of the ink layer 178 on the interior of the cap. The light source transmits light through the ink layer 178. The light then passes through the base material of the cap 114 (which is white) and is projected outward through the letters 184.

Similarly, during the night time or when the button is illuminated from behind, the graphic 186 has a transmitted or fourth color which is the color which is transmitted to the exterior of the upper surface of the cap. This transmitted or fourth color will depend upon the method utilized to manufacture the button. This fourth color can be the color of the light source, the color of the ink layer 178 on the interior upper surface of the cap 114, the color of the decorative paint layer or a combination of these colors.

For example, in this particular embodiment, the transmitted or fourth color for the graphic 186 is the color of the ink layer 178 on the interior of the cap. The light source transmits light through the ink layer 178. The light then passes through the base material of the cap 114 (which is white) and is projected outward through the graphic 186.

While specific embodiments of the invention have been shown and described, it will be understood, of course, that the invention is not limited thereto since modifications may be made and other embodiments of the principles of this invention will occur to those skilled in the art to which this invention pertains. Therefore, it is contemplated by the appended claims to cover any such modifications and other embodiments which incorporate the features of this invention within the true spirit and scope of the following claims.

What is claimed is:

1. An illuminated multiple color button for use in a device requiring transmission of light from a light source through the button, comprising a cap with first indicia including a first color means and second indicia including a second color means which provide said first and second indicia with a first reflected color and a second reflected color respectively, a light pipe which is attached to said cap and communicates light from said light source to said cap, and a third color means which is located between said cap and said light pipe which provides a transmitted third color to selected indicia when light is transmitted through said light pipe.

2. The invention as in claim 1 wherein said first color means is a portion of the base material of said cap.

3. The invention as in claim 1 wherein said second color means is a material applied to a portion of the exterior surface of said cap.

4. The invention as in claim 1 wherein said third color means is a material applied to a portion of said light pipe.

5. The invention as in claim 1 wherein said third color means is a material applied to a portion of the interior surface of said cap.

6. The invention as in claim 1 wherein said third color means is a filter located between said cap and said light pipe.

7. The invention as in claim 1 wherein a transmitted fourth color is provided to said first indicia when light is transmitted through said first color means and said third color means which are subjacent to each other.

8. The invention as in claim 1 wherein a transmitted fourth color is provided to said second indicia when light is transmitted through said second color means and said third color means which are subjacent to each other.

9. An illuminated multiple color button for use in a device requiring transmission of light from a light source through the button, comprising a cap with first indicia including a first color means and second indicia including a second color means which provide said first and second indicia with a first reflected color and a second reflected color respectively, a light pipe which is attached to said cap and communicated light from said light source to said cap, said light pipe has a third color means which provides a third transmitted color to selected indicia when light is transmitted through said light pipe.

10. The invention as in claim 9 wherein said first color means is a portion of the base material of said cap.

11. The invention as in claim 9 wherein said second color means is a material applied to a portion of the exterior surface of said cap.

12. The invention as in claim 9 wherein said third color means is the base material of said light pipe.

13. The invention as in claim 9 further comprising a fourth color means which is located between said cap and said light pipe and which provides a transmitted fourth color to selected indicia when light is transmitted through said light pipe.

14. The invention as in claim 13 wherein said fourth color means is a material applied to a portion of said light pipe.

15. An illuminated multiple color button for use in a device requiring transmission of light from a light source through the button, comprising a cap with first indicia including a first color means and second indicia including a second color means which provide said first and second indicia with a first reflected color and a second reflected color respectively, a chassis which is attached to said cap and communicates light from said light source to said cap, and a third color means which is located between said second color means and said light source which provides a transmitted third color to said second indicia when light is communicated through said chassis.

16. The invention as in claim 15 wherein said first color means is a portion of the base material of said cap.

17. The invention as in claim 15 wherein said second color means is a material applied to a portion of the exterior surface of said cap.

18. The invention as in claim 15 wherein said third color means is a material applied to a portion of the interior surface of said cap.

19. The invention as in claim 15 wherein said third color means is a filter located between said cap and said chassis.

20. The invention as in claim 15 wherein a transmitted fourth color is provided to said first indicia when light is transmitted through said first color means and said third color means which are subjacent to each other.

21. The method of manufacture of illuminated multiple color buttons for use in a device requiring transmission of light through the button, comprising the following steps:

(A) mold a cap in a first color material;
(B) mold a light pipe in a clear material;
(C) decorate a surface portion of the cap with a material of a second color;
(D) decorate a surface portion of the light pipe with a material of a third color;
(E) apply a material of a fourth color to a surface of the cap which includes the surface portion decorated with the second color material;
(F) selectively remove portions of said material of a fourth color on said cap from areas adjacent to and over said second color material to create graphics or letters;
(G) assemble said light pipe to said cap.

22. The method of manufacture of illuminated multiple color buttons for use in a device requiring transmission of light through the button, comprising the following steps:

(A) mold a cap in a first color material;
(B) mold a light pipe in a second color material;
(C) decorate a surface portion of the cap with a material of a third color;
(D) apply a material of a fourth color to a surface of the cap which includes the surface portion decorated with the third color material;
(E) selectively remove portions of said material of a fourth color on said cap from areas adjacent to and over said third color material to create graphics or letters;
(G) assemble said light pipe to said cap.

23. The method of manufacture of illuminated multiple color buttons for use in a device requiring transmission of light through the button, comprising the following steps:

(A) mold a cap in a first color material;

(B) mold a light pipe;

(C) decorate a surface portion of the cap with a material of a second color;

(D) apply a material of a third color to a surface of the cap which includes the surface portion decorated with the second color material;

(E) selectively remove portions of said material of a third color on said cap from areas adjacent to and over said second color material to create graphics or letters;

(F) position a filter of a fourth color between said light pipe and said cap, and assemble said light pipe to said cap.

* * * * *